United States Patent [19]

Finsterwalder et al.

[11] 4,013,003

[45] Mar. 22, 1977

[54] PRESS WITH TOGGLE JOINT DRIVE MECHANISMS

[75] Inventors: Kurt Finsterwalder, Goeppingen; Günter Riedisser, Eislingen, both of Germany

[73] Assignee: L. Schuler GmbH, Germany

[22] Filed: Jan. 19, 1976

[21] Appl. No.: 650,065

[30] Foreign Application Priority Data

Jan. 17, 1975 Germany ..... 2501748

[52] U.S. Cl. ..... 100/285; 100/286

[51] Int. Cl.[2] ..... B30B 1/14

[58] Field of Search ..... 100/285, 286, 214, 283, 100/280, 282; 74/25, 51; 72/451

[56] References Cited

UNITED STATES PATENTS

| | | | |
|---|---|---|---|
| 2,085,648 | 6/1937 | Glasner | 100/285 |
| 3,817,139 | 6/1974 | Desai | 100/282 |

*Primary Examiner*—Billy J. Wilhite

*Attorney, Agent, or Firm*—Craig & Antonelli

[57] ABSTRACT

A plurality of toggle drive mechanisms are provided for transferring rotational shaft movement as linear movement of a press ram guidably supported in a press frame. Each of the toggle joint drive mechanisms includes a triangular shaped drive member eccentrically driven by a crankshaft, which drive member is pivotally connected to a pair of respective facing link members, which link members in turn are pivotally attached one each to the press frame and the press ram. The pivotal connection of the link members to the drive members are at corners of the triangle facing away from the smallest acute angle corner of the guide member. In one preferred embodiment, four separate such toggle joint drive mechanisms are provided for a single press ram and are connected by way of lower link members at four respective ram coupling points of the press ram. Other preferred embodiments include only two ram coupling points, with symmetrical drive being obtained by way of pin members interconnecting triangular guide members at opposite sides of a third triangular guide member, and with one of the sets of link members being connected to these pins so that the link members are symmetrically arranged with respect to link members attached at the third guide member.

11 Claims, 5 Drawing Figures

PRESS WITH TOGGLE JOINT DRIVE MECHANISMS

BACKGROUND AND SUMMARY OF THE INVENTION

This invention relates to a press with knee or toggle joint drive mechanisms of the type including a press frame and a press ram guidably supported for linear movement at the press frame. A plurality of toggle joint drive mechanisms are provided, each of which include a drive member, a first link member, and a second link member, the first link member having one portion thereof pivotally connected to a ram coupling point of the press ram and another portion thereof pivotally connected to a first coupling point of the drive member. The second link member has a portion thereof pivotally connected to a frame coupling point of the press frame and a second portion thereof pivotally connected to a second coupling point of the drive member at a position spaced from and facing the first coupling point. Rotatable drive crankshaft means are provided for applying driving forces to the drive member.

U.S. Pat. No. 2,085,648 is exemplary of prior art presses with such toggle joint drive mechanisms. Each knee or toggle joint drive mechanism consists of two links (arms, stilts), wherein one link is hingedly joined with one end to a power transmission member or a press ram in a ram hinge or coupling point and with the other end to the second link. The second link is fashioned as a rocking lever and is rotatably mounted in a frame coupling point. While one rocker arm of the second link is connected to the link hingedly joined in the ram coupling point, a drive member engages the second link, which drive member is eccentrically supported on a gear wheel. The gear wheel proper is supported on an axle disposed symmetrically with respect to the toggle lever drives. The gear wheels associated with the further toggle joint drive mechanisms are also disposed on this axle, so that a symmetrical structure can be realized. In case of a press constructed with the aforementioned toggle joint drive mechanisms with several pressure points, however, only an almost symmetrical motion operation of a ram and/or of a blank holder can be achieved, as seen over a rotation of the crankshaft.

In many cases of application of a press, it is desirable to attain a nonsymmetrical motion operation, in such a way that a crankshaft rotation of the press drive mechanism is subdivided into a ram motion with an initial phase and a final phase with high speed and a relatively long path and an interposed operating phase with an almost constant, low velocity and a relatively small path.

The very old German Pat. No. 38,701 suggested, for the drive mechanism of a blank holder, to construct a toggle joint drive mechanism with a triangular guide means wherein the corner of the triangular guide means forming an acute angle is eccentrically joined to drive means, while the two corners facing away from the acute angle are connected to mutually facing ends of two links. The ends of the links which face away from each other are hingedly connected, on the one hand, to a blank holder and, on the other hand, in the extension of the travel path of the blank holder to a press frame.

More recent solutions of the aforementioned requirement for a nonsymmetrical operation of a press ram and/or of a blank holder disclose complicated joint drive mechanisms for presses with a pressure point, such as they are described, for example, in the technical book "Die Mechanischen Pressen" (The Mechanical Presses) by Heinrich Makelt, published by Carl Hanser Verlag, Munich, 1961, p. 88, and German Published Application No. (DOS) 2,000,669.

This invention is based on the problem of avoiding the conventional, complicated, and troublesome drive mechanisms and of applying certain aspects of a previously contemplated drive mechanism for a blank holder, together with its advantages, to a drive mechanism for a press and with toggle joint drive mechansims engaging several pressure points of the press ram, in order to obtain a nonsymmetrical motion operation of the press ram during a rotation of the crankshaft.

According to preferred embodiments of the present invention, the above-mentioned problems and disadvantages are avoided by a press of the above-described type by providing that each drive member is an acute-angled triangular guide member having the acute angle corner thereof (smallest angle corner) connected to the drive means for movement therewith, and with said first and second coupling points for the link members being at the other respective corners of the guide member.

According to certain preferred embodiments of the present invention, each press ram is provided with four pressure points at which respective link members of four respective separate toggle joint drive mechanisms are connected, with said four coupling points at the press ram being disposed to impart symmetrical application of force on the press ram.

According to other preferred embodiments of the present invention, the press ram is connected hingedly to the link members only at two pressure points. In order to obtain symmetrical application of forces with two pressure points, three separate triangular shaped guide members are provided. A first and second of these guide members are disposed axially externally of the third guide member. The third guide member is connected to the link members for one of the pressure points. On the other hand, the first and second guide members are interconnected with one another at the respective corners opposite the smallest angle acute angle by way of pin members. These pin members in turn are articulated to respective link members attached to the frame and the press ram, with the attachment at the press ram being in the same plane, along the length of the axis of the rotational shaft for driving the guide members, as is the connection of the third guide member link member to the press ram.

The preferred embodiments of the present invention are very advantageous with respect to the small number of moving parts required, the provision of a central drive shaft from which movements of all the toggle joint drive mechanisms can be easily obtained in a symmetrical force applying manner at the press ram, and in the simplified arrangement for converting the rotation of the crankshaft to the respective opposite rotation of the symmetrically disposed toggle joint drive mechanism to effect the linear movement of the press ram.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
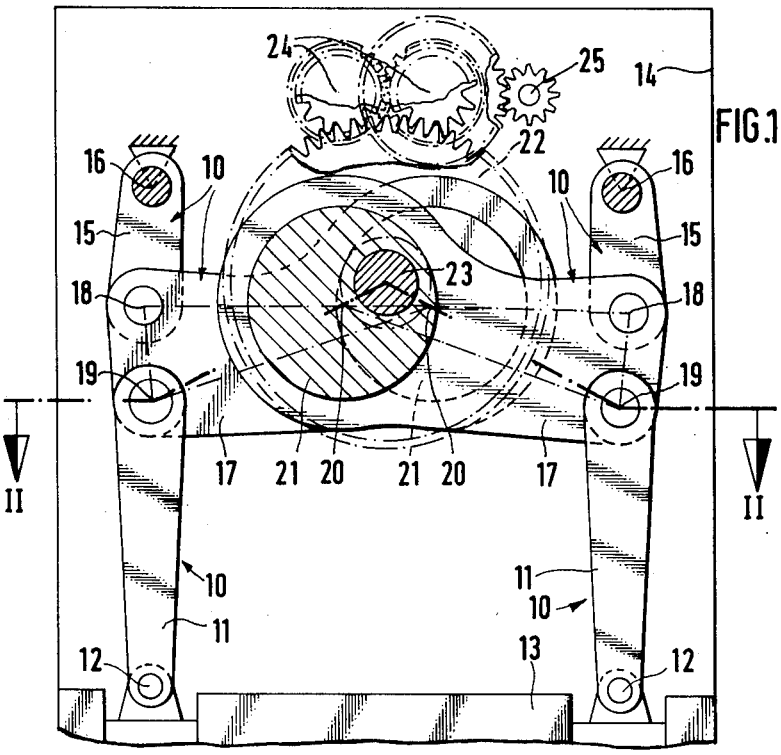
FIG. 1 is a schematic front view of a first embodiment of a press constructed in accordance with the present invention with toggle joint drive mechanisms hingedly connected to four ram coupling points of a press ram.
Figure 2:
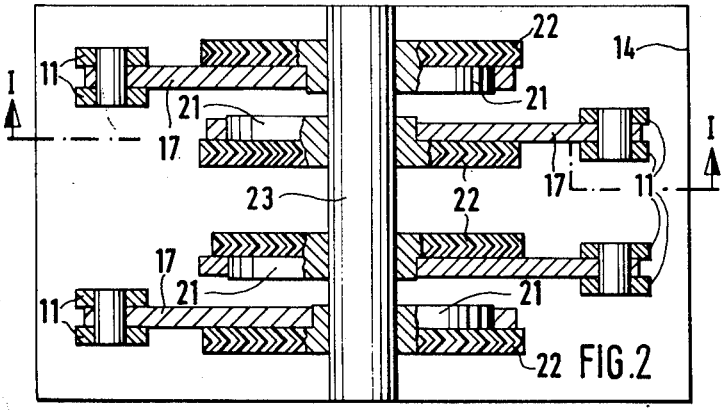
FIG. 2 is a partial sectional schematic view along line II—II of FIG. 1.

FIGS. 1 and 2 show a press with four toggle joint drive mechanisms 10. Lower links 11 are hingedly joined in four respective ram coupling points 12, arranged symmetrically to one another — representing pressure points — to a press ram 13. The press ram 13 is guided in a press frame 14 to which are fixedly mounted upper links 15 of the toggle joint drive mechanisms 10 in frame coupling points 16. Each upper and lower link 15, 11 is hingedly joined with the mutually facing ends to corners 18, 19 facing away from an acute angle (<45°) of a triangular guide means 17. The corners 20 of the triangular guide means 17 forming the acute angle are pivotally joined to eccentrics 21, which latter are connected to gear wheels 22, the gear wheels in turn being rotatably supported centrally and symmetrically on an axle 23. The axle is disposed in the press frame 14 symmetrically to the ram coupling points 12.

The gear wheels 22 are driven in opposition in pairs, corresponding to the symmetrical arrangement on the axle 23. For this purpose, reversing gear wheels 24 are used in pairs, one gear wheel being driven by way of a pinion 25 in operative connection via a driven plate or flywheel — not shown — with a drive motor — also not shown.

The motion operation of the toggle joint drives 10 takes place simultaneously, in the same direction of the press ram movement, and with identical velocity, wherein the press ram 13 is moved in the initial and final phases at a high speed and in the interposed operation phase with a minor velocity, so that a nonsymmetrical motion operation is the result during a ram stroke. In FIG. 5, a diagram of the stroke 27 of the press ram 13 is shown over the crankshaft anlge of rotation 28 for toggle joint drive mechanisms constructed in accordance with FIGS. 1 to 4 of the invention. The characteristic curve 29 shows a high speed of the press ram in the initial and final stroke phases, whereas, in an operating phase 30 (from 120° to 210° of the crankshaft angle 28) the press ram 13 is moved in an almost constant, relatively low velocity.

Figure 3:
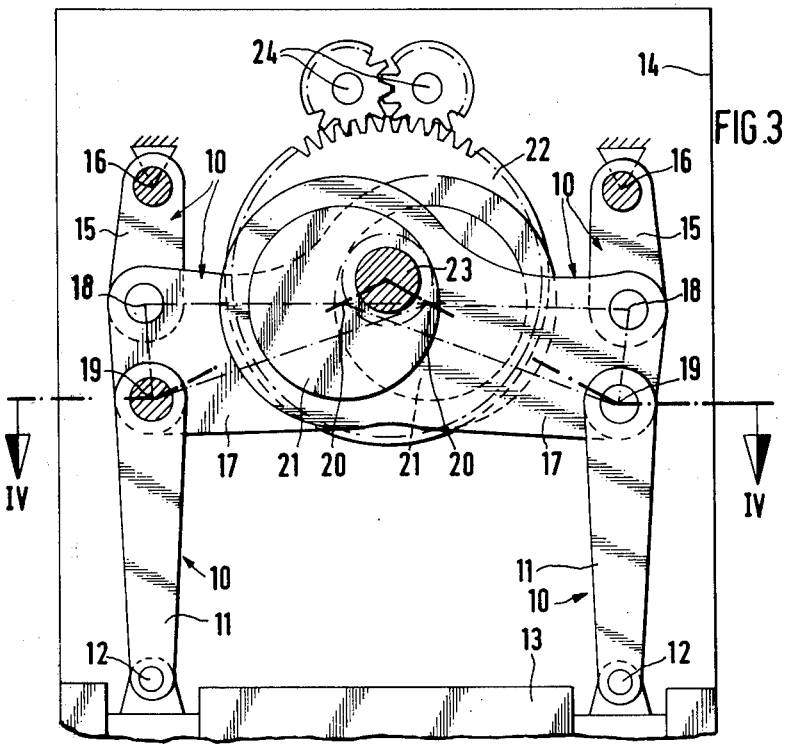
FIG. 3 is a schematic front view of a further embodiment of a press constructed in accordance with the present invention with toggle joint drive mechanisms hingedly connected to two ram coupling points of a press ram.
Figure 4:
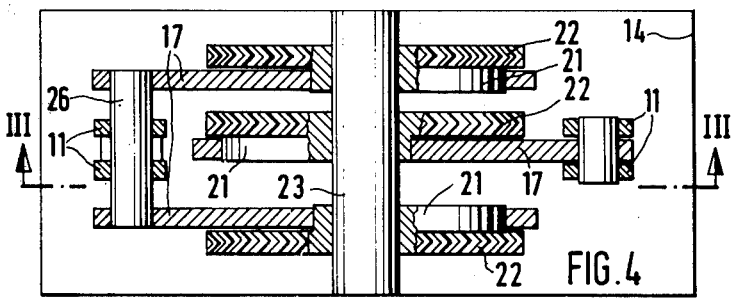
FIG. 4 is a partial-sectional schematic view along line IV—IV of FIG. 3.
Figure 5:
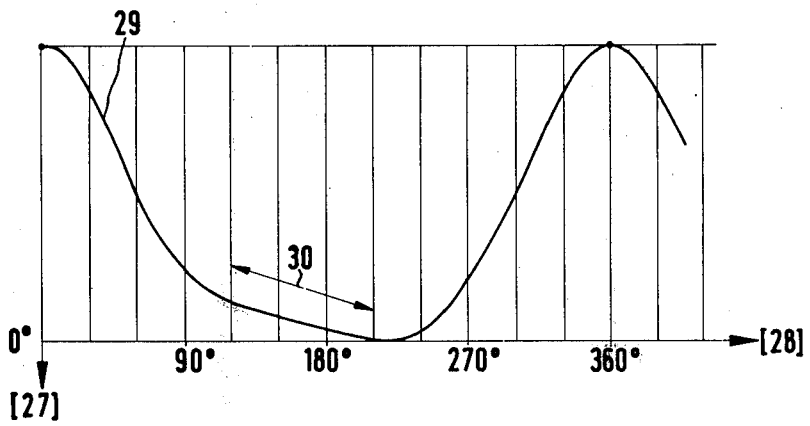
FIG. 5 is a diagram of the linear stroke path of the press ram as a function of the drive crankshaft rotational angle for presses constructed in accordance with preferred embodiments of the present invention.

The second illustrated embodiment according to FIGS. 3 and 4 shows, in principle, a similar construction of the toggle joint drive mechanisms 10 as in the embodiment of FIGS. 1 and 2. The essential difference in the second embodiment resides in that two toggle joint drive mechanisms 10 are provided which are articulated in two ram coupling points 12 with the lower links 11 and in two frame coupling points 16 with the upper links 15 (rather than four drive mechanisms and coupling points as in the FIGS. 1 and 2 embodiments). To attain a symmetrical structure, two triangular guide means 17 are supported on the associated eccentrics 21 externally with gear wheels 22 rotating in the same direction, whereas an interiorly disposed triangular guide means 17 is supported, between the gear wheels 22 rotating in the same direction, on a gear wheel 22 operating in opposition thereto, on the associated eccentric 21. The externally positioned triangular guide means 17 are connected in the corners 18, 19 by means of pins 26, to which the links 11, 15 are articulated. The gear wheels 22 are driven by reversing gear wheel pairs 24, wherein one of the reversing gear wheels 24 can be arranged directly on a shaft of a flywheel or driven plate (not shown). The flywheel is operated by a drive motor (not shown).

The motion operation of the second embodiment results in equivalence to the operation of the first example, described hereinabove and graphically depicted in FIG. 5.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Press comprising:

press frame means, a press ram guidably supported at said press frame means, a plurality of toggle joint drive mechanisms, each of said toggle joint drive mechanisms including a drive member, a first link member, and a second link member, said first link member having one protion thereof pivotally connected to a ram coupling point of said press ram and another portion thereof pivotally connected to a first coupling point of said drive member, said second link member having one portion thereof pivotally connected to a frame coupling point of said press frame means and a second portion thereof pivotally connected to a second coupling point of said drive member at a position spaced from and facing said first coupling point, and rotatable drive means for applying driving forces to said drive members, wherein each drive member is an acute-angled triangular guide member having the acute angle corner thereof connected to said drive means for movement therewith, and wherein said first and second coupling points are at respective corners of said guide member other than said acute angle corner.

2. Press according to claim 1, wherein said ram coupling points are symmetrically positioned.

3. Press according to claim 2, wherein said drive means includes a plurality of drive wheels rotatably mounted on a common shaft, said drive wheels being driven in respective opposite rotational directions by oppositely rotating gear wheels.

4. Press according to claim 3, wherein said press frame coupling points are arranged approximately in alignment with the linear travel path of corresponding facing ram coupling points.

5. Press according to claim 4, wherein four of said toggle joint drive mechanisms are provided with four respective ram coupling points at the press ram, two of said ram coupling points being disposed at each of the respective opposite sides of the common axes of said rotatable drive means.

6. Press according to claim 4, wherein first and second of said triangular guide members are eccentrically articulated to respective different gear wheels rotating in the same direction, wherein a third of said triangular guide members is eccentrically articulated to a third gear wheel rotating in a direction opposite said first mentioned gear wheels, said third triangular guide member being disposed axially intermediate said first and second triangular guide members, wherein pin means interconnect said first and second triangular guide members at the respective corners thereof facing away from said acute angle corners, and wherein said first and second coupling points are at said pin means intermediate said first and second triangular guide members.

7. Press according to claim 1, wherein said press frame coupling points are arranged approximately in alignment with the linear travel path of corresponding facing ram coupling points.

8. Press according to claim 1, wherein four of said toggle joint drive mechanisms are provided with four respective ram coupling points at the press ram, two of said ram coupling points being disposed at each of the respective opposite sides of the common axes of said rotatable drive means.

9. Press according to claim 1, wherein first and second of said triangular guide members are eccentrically articulated to respective different gear wheels rotating in the same direction, wherein a third of said triangular guide members is eccentrically articulated to a third gear wheel rotating in a direction opposite said first mentioned gear wheels, said third triangular guide member being disposed axially intermediate said first and second triangular guide members, wherein pin means interconnect said first and second triangular guide members at the respective corners thereof facing away from said acute angle corners, and wherein said first and second coupling points are at said pin means intermediate said first and second triangular guide members.

10. Press according to claim 1, wherein said toggle joint drive mechanisms are configured to impart a travel path for said press ram with initial and final stroke phases of high speed and an operating phase of almost constant, relatively slower speed, said operating phase occurring from 120° to 210° of the drive crankshaft rotational angle.

11. Press according to claim 1, wherein said acute angle of said triangular guide member is less than 45°.

* * * * *